US005213331A

United States Patent [19]

Avanzini

[11] Patent Number: 5,213,331

[45] Date of Patent: May 25, 1993

[54] GOLF TRAINING PUTTER

[76] Inventor: Frank Avanzini, 1560 Nottingham Dr., Winter Park, Fla. 32792

[21] Appl. No.: 876,858

[22] Filed: Apr. 30, 1992

[51] Int. Cl.[5] ..... A63B 69/36

[52] U.S. Cl. ..... 273/186.3; 273/194 A

[58] Field of Search ..... 273/186.2, 187.4, 194 A, 273/83, 194 R, 163 R, 163 A, 186.3; 434/252

[56] References Cited

U.S. PATENT DOCUMENTS

| | | | |
|---|---|---|---|
| 3,802,709 | 4/1974 | Elkins, Jr. | 273/186.3 |
| 3,953,034 | 4/1976 | Nelson | 273/186.3 |
| 4,083,560 | 4/1978 | Kikuchi et al. | 273/102.2 B |
| 4,367,877 | 1/1983 | Gibson et al. | 273/187.4 |
| 4,971,327 | 11/1990 | Rabold | 273/186.3 |
| 4,997,189 | 3/1991 | Perkins | 273/181 H |
| 5,029,868 | 7/1991 | Cloud | 273/186.3 |

*Primary Examiner*—George J. Marlo
*Attorney, Agent, or Firm*—Foley & Lardner

[57] ABSTRACT

A putter with laser sighting including a laser unit formed with or permanently mounted onto the putter head. The laser unit also can be a part of a kit which can be mounted onto the putter head of a conventional putter. The laser unit is adjustably mounted on the putter head for adjustment of the laser beam in a vertical plane perpendicular to the putter's ball striking surface so that the laser beam may be projected over the top of a golf ball onto a putting surface at select distances forwardly of the golf ball. The laser unit preferably includes a button mounted on the handle of the putter. The button is utilized by the golfer to activate the laser beam when the golfer is aligning the putter and during the putting stroke to illustrate the direction and alignment of the putting stroke.

8 Claims, 8 Drawing Sheets

GOLF TRAINING PUTTER

BACKGROUND OF THE INVENTION

The present invention relates generally to a golf putter teaching or training device and more particularly to a golf putter with laser sighting and a laser sighting kit for a golf putter.

Numerous types of training and teaching devices have been developed in an attempt to improve a golfer's putting stroke and alignment. It has been stated that the major difference in today's golfers is found in the putting portion of the game of golf. In fact, many modern golf courses have been designed to make putting an even more important phase of the game.

The putting stroke generally includes several phases: the address or set-up phase which the golfer initially assumes in relation to the ball with the clubhead located behind the ball before hitting a shot; the backswing phase in which the club is drawn back into a cocked position; the striking phase in which the putter is moved to and through the ball; and the follow-through phase of the stroke in which the putter is moved past and beyond the hitting zone to finish the stroke.

There is need for a device to enable the golfer to be confident of their initial aim at the target and their execution during play. Enhanced practice can achieve that goal. Accurate putting demands precise application of distance and direction factors. Distance problems generally are easily seen, and can be corrected; however, alignment factors are less easy to visualize. First, it is difficult to ascertain the alignment between the putter and the aiming/target spot, such as the cup. There is a need for a device that allows an accurate check of putter aim and which allows the golfer to actually visualize correct putter direction, thus making it possible to repeat on the golf course. Also, there is a need for a device that allows a check on the quality of the putting motion itself.

The direction of a putt is greatly affected by the slope and condition of the putting surface. However, once a target path is chosen, putting direction is affected mainly by three factors. One is the area of contact on the putter blade. Off center impact can cause the putter blade to open or close. The second factor is the actual path of the putter head. The third and most important factor is the direction of the putter face during impact. It is almost impossible for a golfer to see, i.e., visualize, these alignment problems. In fact, certain erroneous combinations of these factors will result in a perfect looking putt result. In effect, two wrongs make a right. If the initial aim is wrong, the stroke must be wrong to correct the result; however, most golfers do not want to learn this way. The least complex method is correct aim and a matching stroke. There thus is need for a device that allows the golfer to actually see each alignment factor during practice execution and to explore ways to prevent or correct any alignment problems while practicing.

The present invention is directed at improving the putting portion of the golfer's game, by helping the golfer to develop an improved putting swing or stroke, and in particular by helping the golfer to aim correctly.

Prior art devices known for improving the putting game have included a large variety of aids such as practice holes or cups, pieces of carpet for simulating greens, sights mounted on the clubs, target devices for the holes, and so forth.

Some optical devices have also been produced in the past to provide a visual indication of whether the full swing is properly carried out, or is more likely to produce a slice or a hook. Such optical devices typically have used a series of mirrors or lenses to produce the desired result. However, as the number of mirrors and/or lenses increases, so does the complexity of the devices along with the cost.

These prior art aiming and training aids have in general been complex and have not included an optical unit which can be mounted on the putter head and which optical unit also can be adjustable. It therefore would be desirable to provide a putter with laser sighting, including a laser unit which can be a part of a putter head or can be in a kit form and can be adjustably mounted on the putter head.

SUMMARY OF THE INVENTION

The present invention provides a putter with laser sighting, which includes a laser unit formed with or permanently mounted onto the putter head. The laser unit also can be a part of a kit which can be mounted onto the putter head of a conventional putter. The laser unit can be adjustable to change the path of the laser beam to adjust for different types of putters and different putting strokes and alignment. The laser unit preferably includes a button or switch mounted on the handle of the putter, which is utilized by the golfer to activate the laser beam when the golfer is aligning the putter and during the putting stroke to illustrate the direction and alignment of the putting stroke.

BRIEF DESCRIPTION OF THE DRAWINGS

FIG. 8D is a partial view of the switch button wiring of the laser putting unit kit of FIG. 8A.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1A:
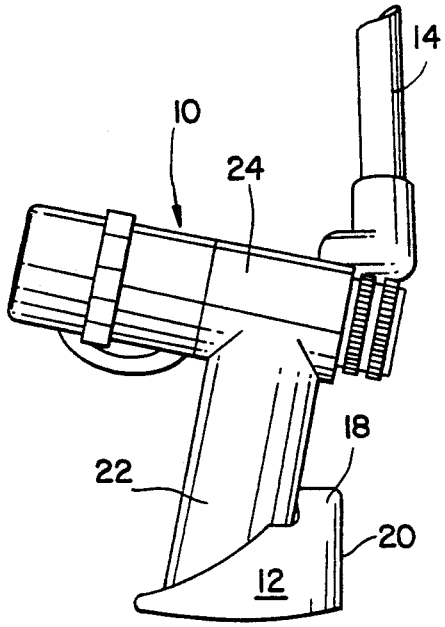
FIGS. 1A-1C, respectively are side, front and top views of one embodiment of a fixed laser putting unit of the present invention.
Figure 1C:
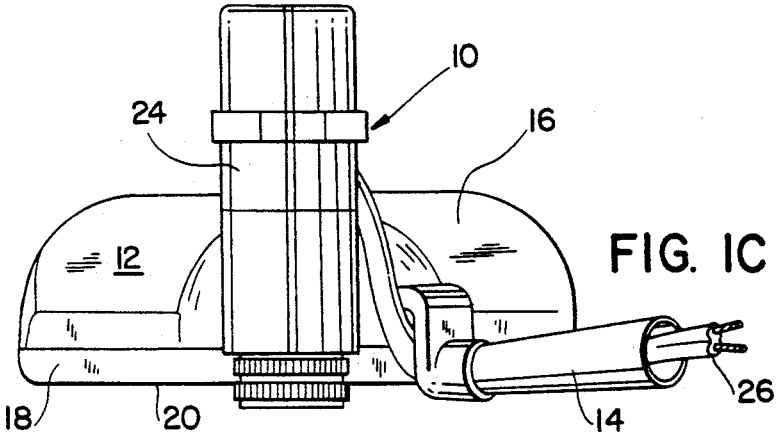
Figure 1B:
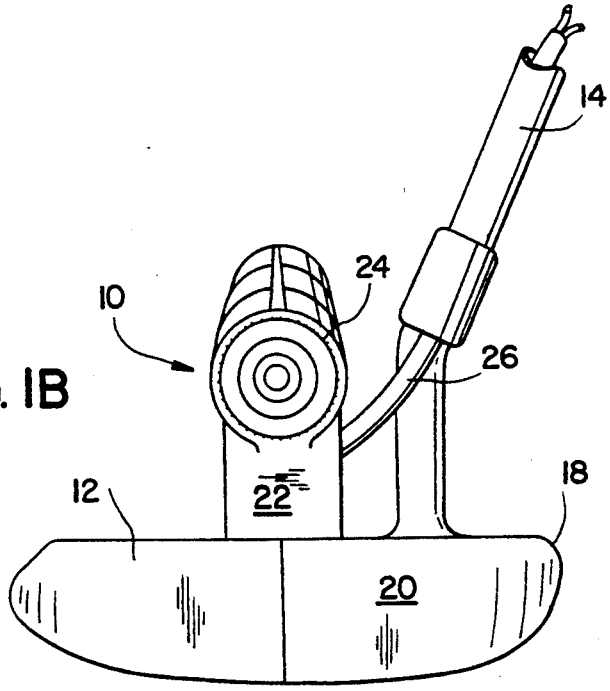
Figure 2:
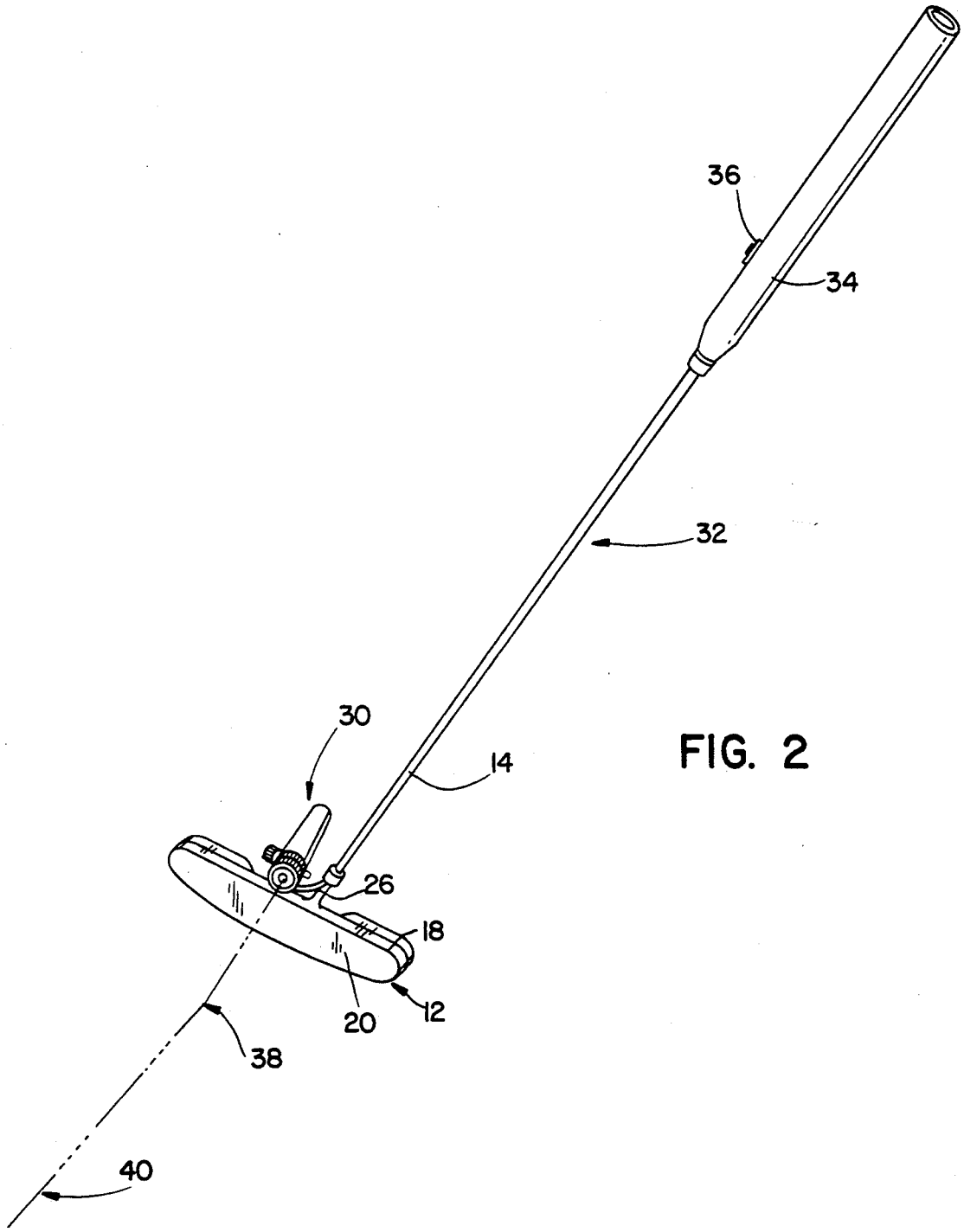
FIG. 2 is a perspective view of a golf putter with an adjustable embodiment of a laser putting unit of the present invention.

Referring to FIGS. 1A-1C, a first fixed laser putting unit of the present invention is designated generally by the reference numeral 10. The laser putting unit 10 is mounted in a fixed position onto a putter head 12 which in turn is mounted onto a putter shaft 14.

The putter head 12 can be any type of conventional putter head. The putter head 12 illustrated is a conventional type, which conveniently includes a shelf 16 formed as a rear ledge to a wall 18. A planar striking surface 20 is formed as the front surface of the wall 18 for striking or putting the golf ball (not illustrated), as is well known.

The laser putting unit 10 includes a base or bracket 22, which can be mounted onto the shelf 16 and the wall 18 by any convenient mounting means, such as screws or adhesive (not illustrated). The laser putting unit 10 also can be formed integrally with the putter head 12, if desired. A laser 24 is mounted onto the bracket 22 and is aligned to direct a laser beam (not illustrated) perpendicular to the plane of the planar striking surface 20 as illustrated in FIG. 1C, but also at an angle to the planar striking surface 20 as illustrated in FIG. 1A. The laser 24 directs the laser beam when activated, such as by the golfer engaging a switch on the putter handle (not illustrated). The switch is electrically coupled to the laser 24 by wiring 26 which is mounted to or into the putter shaft 14.

Referring to FIGS. 2-5, the operation of the invention is illustrated with an adjustable embodiment of the laser putting unit of the present invention, designated generally by the reference numeral 30. The same reference numerals are utilized for the same elements as described in FIG. 1. The laser putting unit 30 is mounted onto the putter head 12 of a golf putter 32. The putter 32 includes the shaft 14 with the putter head 12 mounted on one end thereof and a handle 34 mounted on the other end thereof. A laser activation switch or button 36 is mounted on the handle 34 and is coupled to the laser switch unit 30 by the wiring 26.

Figure 3A:
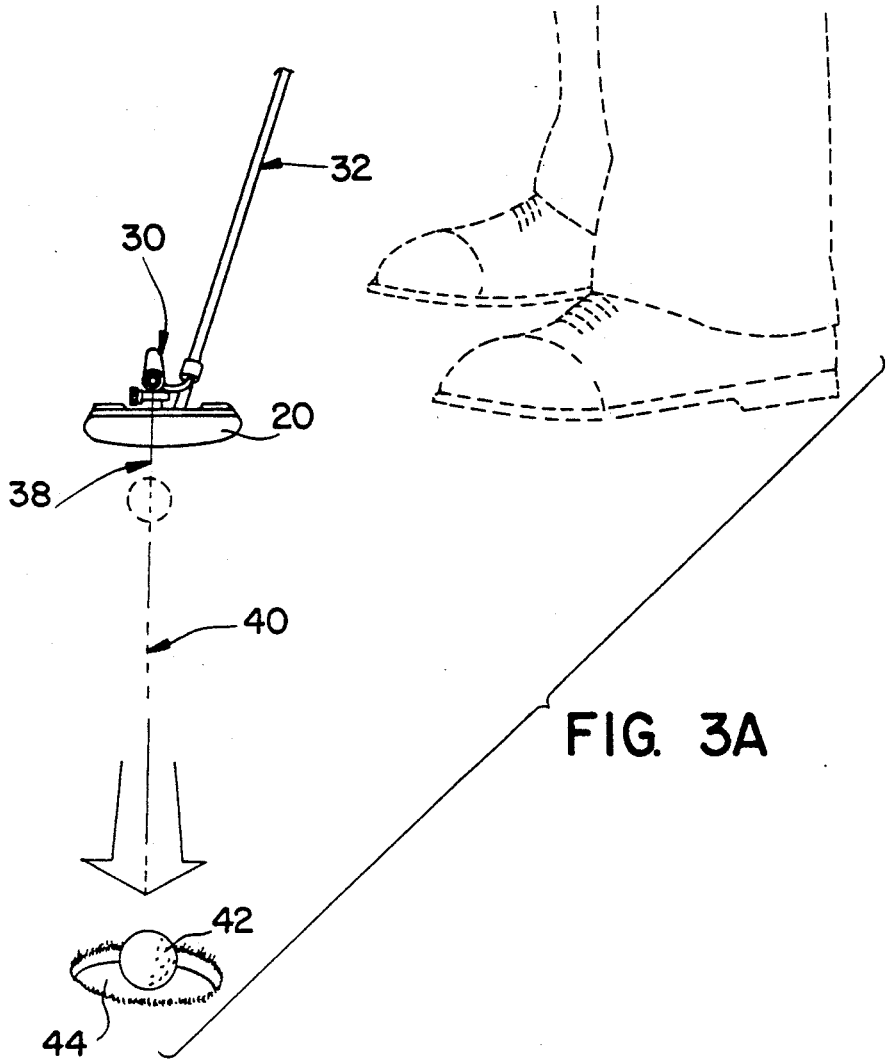
FIG. 3A is a partial perspective view of the laser putting unit of FIG. 2 in use.

When the laser putting unit 30 is activated by the golfer engaging the switch 36, the laser putting unit directs a laser beam 38 transversely of the planar striking surface 20. As the putter 32 is moved during the putting stroke, the laser beam 38 moves along and illuminates a path or line 40. The illuminated line 40 illustrates the alignment and path of the putting stroke to the golfer. The golfer thus can see both the initial alignment with a selected putting line and the path 40 made by the putting stroke. If, as illustrated in FIG. 3A, the path 40 corresponds with the correct putting line, then a golf ball 42 properly struck by the putter ball striking surface 20 will roll along the path 40 and into a cup 44, achieving the desired result. The putting line is illustrated as being directly at the cup 44 for illustration purposes only. Normally, of course, the ball 42 will break one way or the other or both.

Figure 3B:
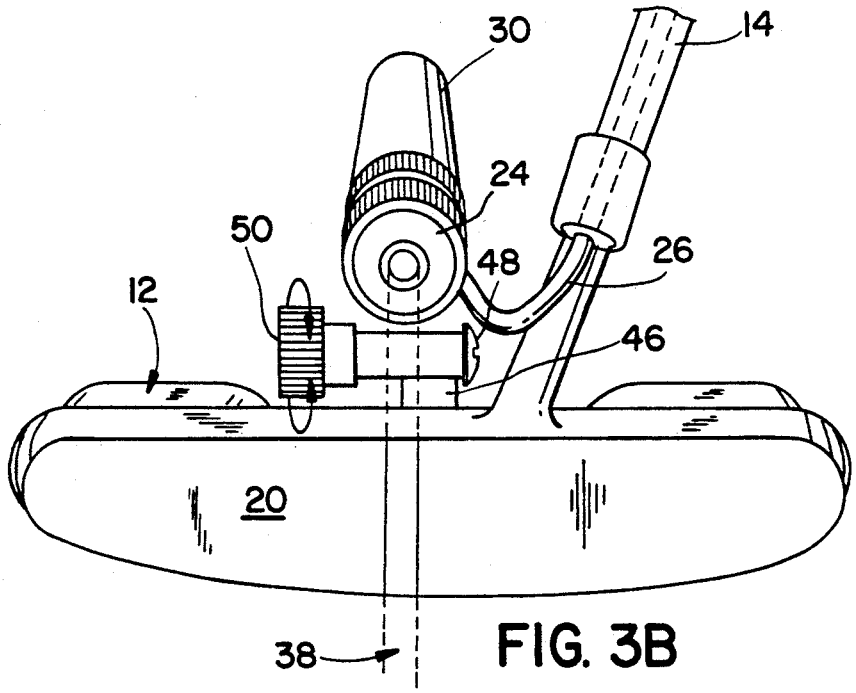
FIG. 3B is an enlarged front view of the laser putting unit of FIG. 3A.

As illustrated in FIG. 3B, the laser putting unit 30 includes the laser 24 adjustably mounted onto a bracket 46, which is mounted onto the putter head 12. The laser 24 is mounted by a pivot assembly 48 and can be adjusted by a knob 50. The adjustably mounted laser unit 30 is preferable, because the laser putting unit 30 can thus accommodate a plurality of different putter heads and putter angles with an easy adjustment. The adjustment also allows the golfer to select the distance from the putter head 12, that the laser beam 38 strikes the putting surface (best illustrated in FIG. 5). The laser putting unit 30 is pivoted or adjusted in a plane substantially perpendicular to the ball striking surface 20.

Figure 4A:
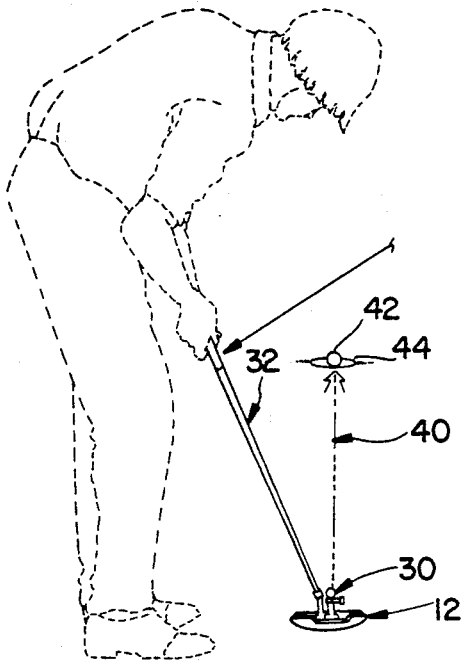
FIG. 4A is a partial perspective rear view of the laser putting unit of FIG. 3A in use.
Figure 4B:
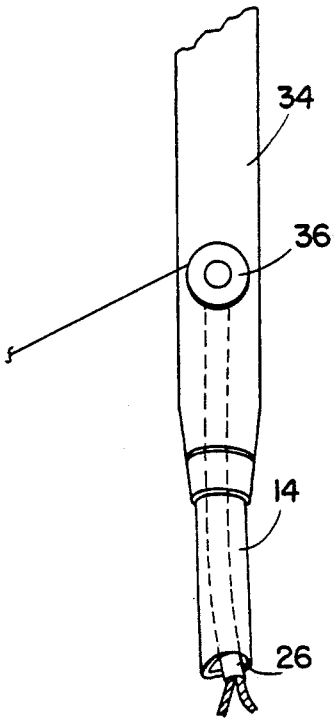
FIG. 4B is a partial view of the putter handle of FIG. 4A.
Figure 4C:
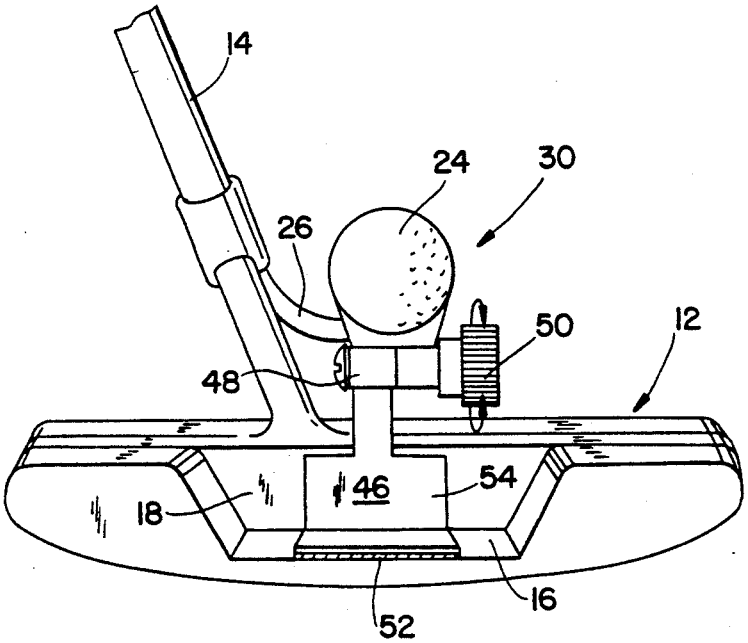
FIG. 4C is an enlarged rear view of the laser putting unit of FIG. 4A.
Figures 5A, 5B:
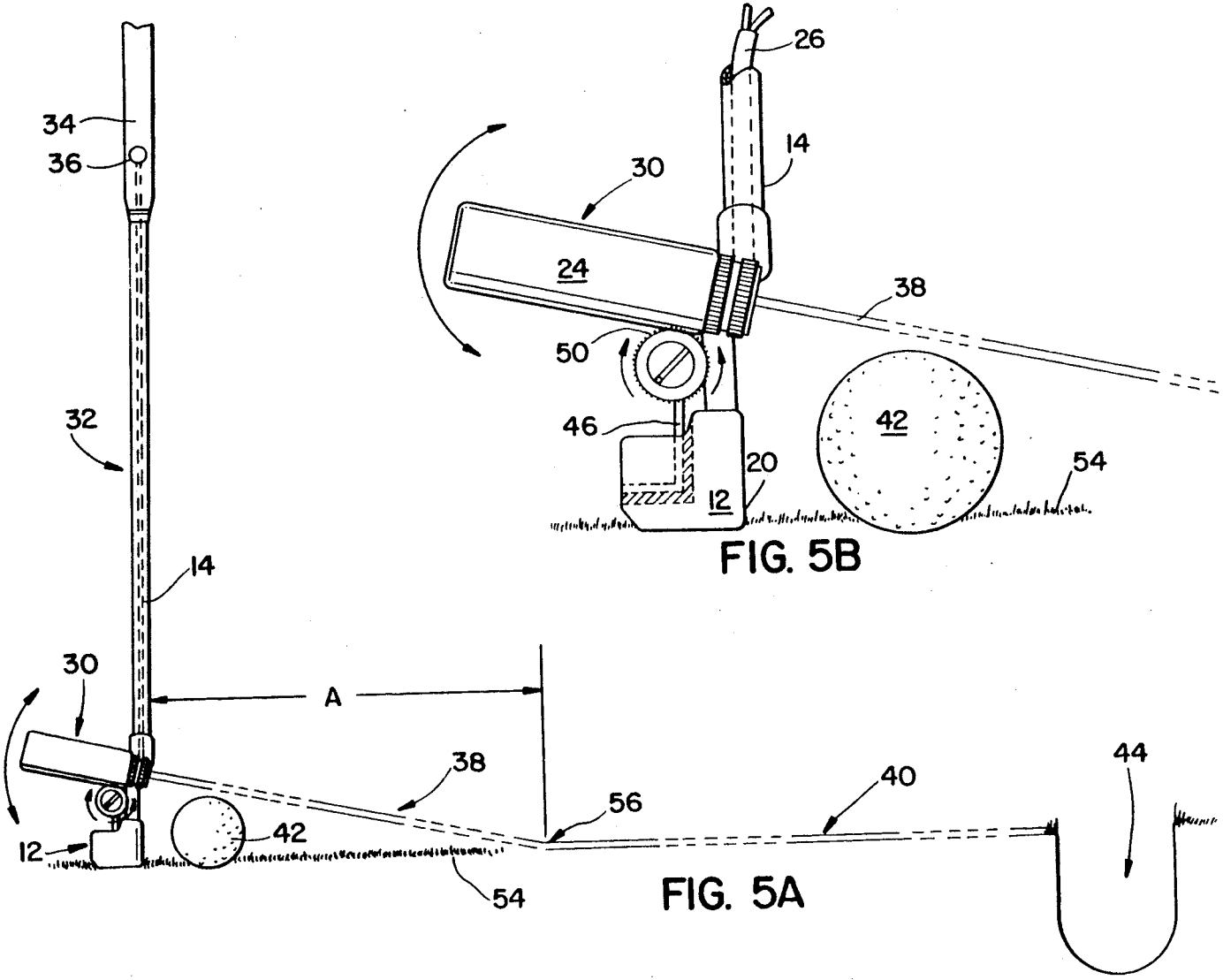
FIG. 5A is a side view of the laser putting unit of FIG. 3A in use.
FIG. 5B is an enlarged side view of the laser putting unit of FIG. 5A.
Figure 6:
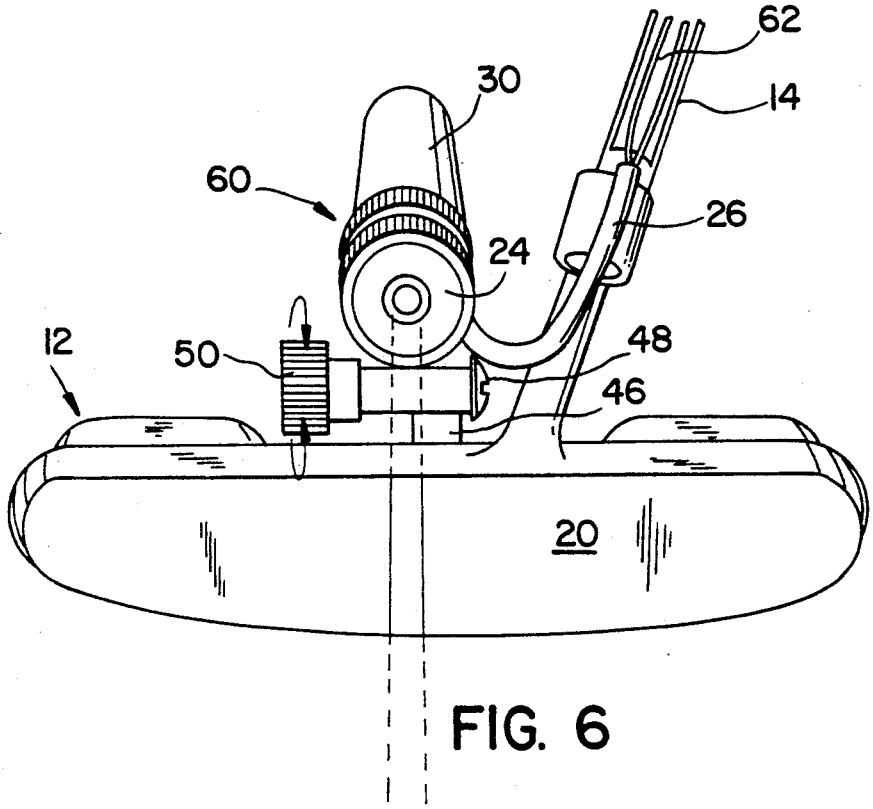
FIG. 6 is a front view of a kit embodiment of the laser putting unit of the present invention.
Figure 7:
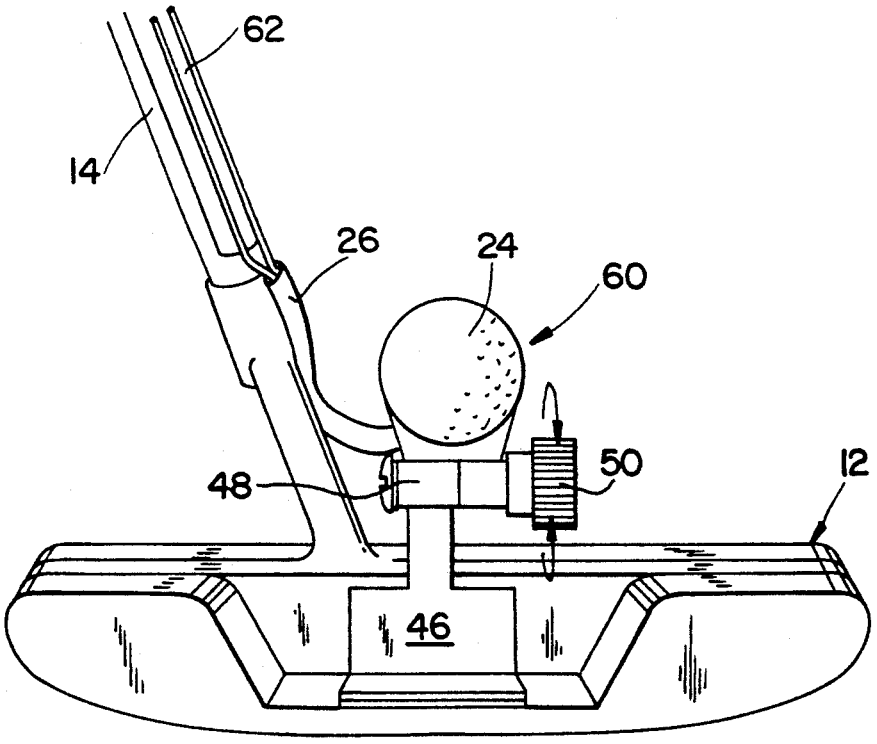
FIG. 7 is a rear view of the laser putting unit kit of FIG. 6.

A rear view of the putter 32 being utilized by a golfer is illustrated in FIG. 4A. The activation button 36 and connections in the handle 34 are best illustrated in FIG. 4B. The pivot assembly 48 of the laser putting unit 30 is best illustrated in FIG. 4C. The bracket 46 can be mounted to the putter head wall 18 and the shelf 16 in any convenient manner, such as by an adhesive layer 52. The bracket 46 can include an L-shaped portion 54, such that it easily can be adhered or otherwise secured to both the shelf 16 and the wall 18.

As described above and as best illustrated in FIGS. 5A and 5B, the laser putting unit 30 can be adjusted to vary the angle of the laser beam 38 with a putting surface 54. This accommodates both the angle the golfer may initially incline the putter 32 as well as the distance "A" between the putter head 12 and a point 56 where the laser beam 38 intercepts the putting surface 54.

The laser putting units 10 and 30 have been described and illustrated as permanently mounted to or integrally formed with the putter head 12. The laser putting unit of the present invention also can be made as a kit embodiment designated generally by the reference numeral 60 in FIGS. 6-8C. The laser putting unit kit 60 includes either a fixed laser putting unit 10 or an adjustable laser putting unit 30, which in either case includes the laser 24. For ease of description, only the adjustable laser putting unit 30 is illustrated.

Figure 8A:
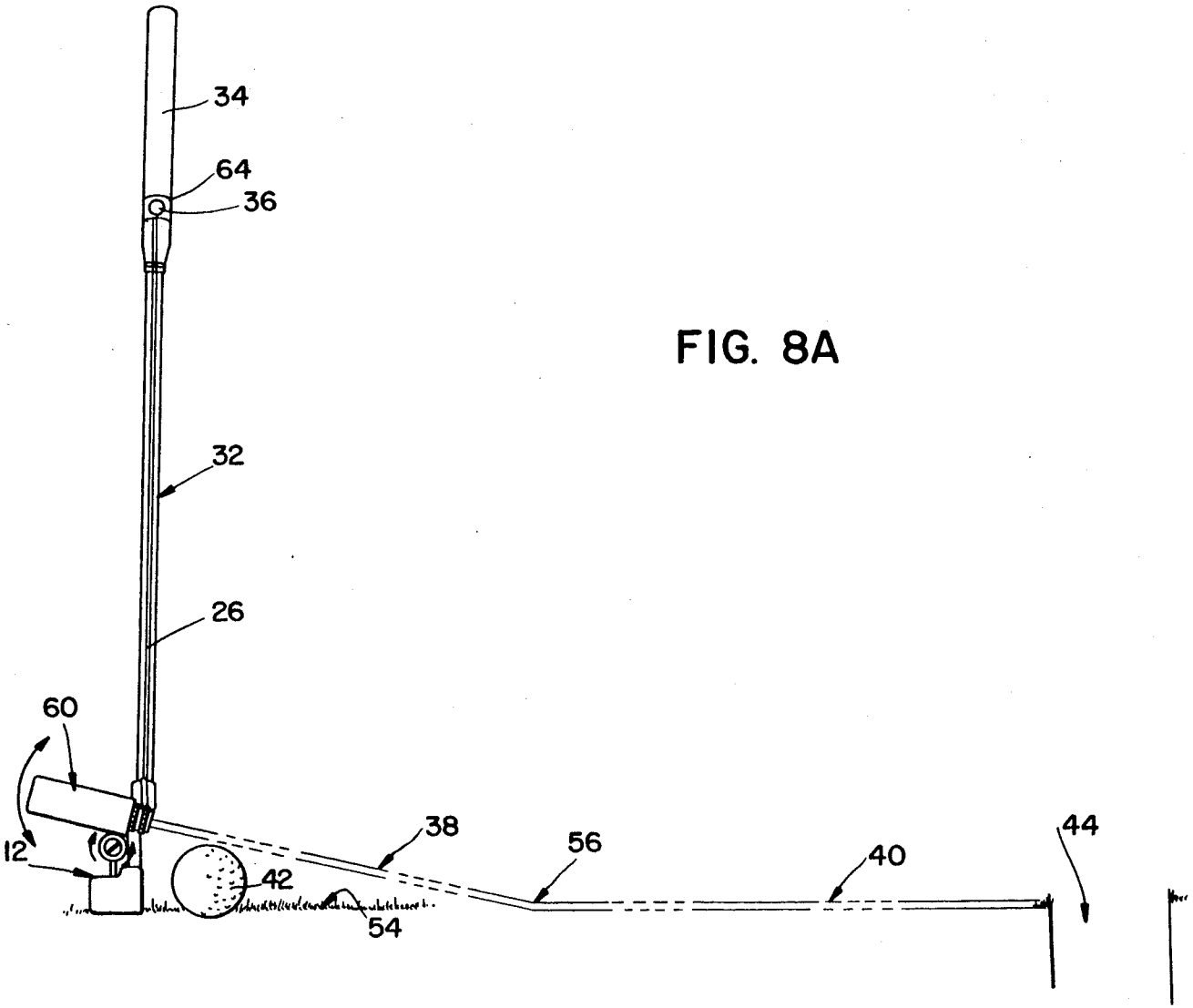
FIG. 8A is a side view of the laser putting unit kit of FIG. 6 in use.
Figure 8B:
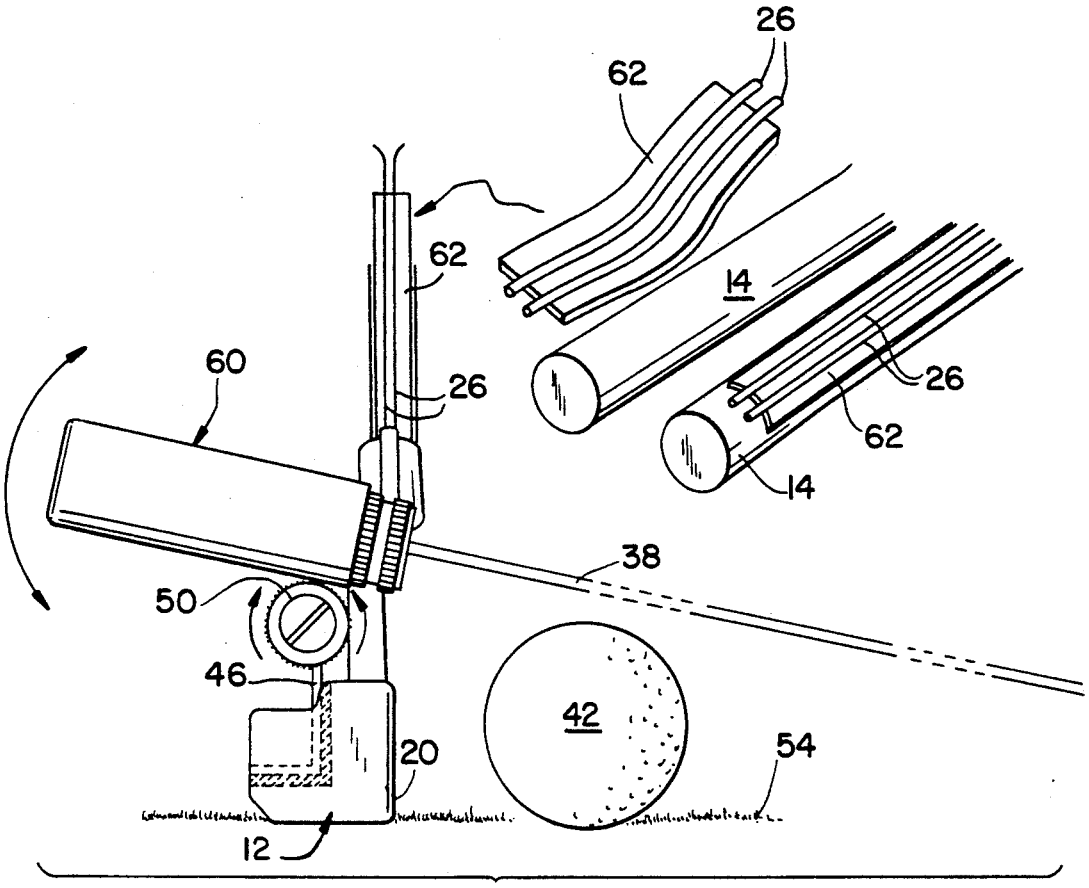
FIG. 8B is an enlarged side view of the laser putting unit kit of FIG. 8A.
Figure 8C:
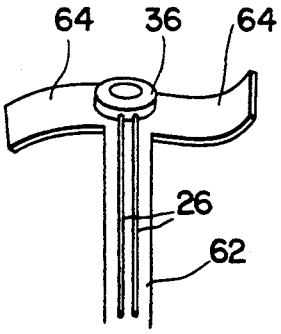
FIG. 8C is a partial view of a switch button of the laser putting unit kit of FIG. 8A.

The kit 60 also includes the wiring 26, which could be assembled inside the putter shaft 14 as previously described, but also can be mounted onto an adhesive tape 62. As illustrated in FIGS. 8A-8C, the kit 60 easily can be applied to the putter 32, such as by a removable adhesive so that the laser putting unit 30 can be utilized on the putter 32 without any modifications to the putter 32 and can be removed, if desired. The button 36 also can be mounted onto the tape 62, which can include a pair of arms 64. The arms 64 are wrapped around the handle 34 to secure the button 36 at the desirable location. The length of the tape 62 and the wiring 26 can be adjusted before mounting to accommodate the putter 32 and the individual golfer.

Modification and variations of the present invention are possible in light of the above teachings. The wiring 26 also could be wound around the shaft 14 and secured thereto if desired. The laser putting units 10 and 30 and the laser putting unit kit 60 can be formed from a plastic, metals (such as aluminum), or other materials, as desired. The type and power of the laser also can be selected as desired. It is therefore to be understood that within the scope of the appended claims, the invention may be practiced other than as specifically described.

What is claimed is:

1. A golf putter with laser sighting, comprising:

a putter shaft including a handle affixed at a first end thereof and a putter head affixed at the other end thereof having a substantially planar ball striking surface on one side thereof;

a laser unit mounted on said putter head including means for directing a laser beam transversely of said ball striking surface when activated, said laser unit being adjustably mounted on said putter head for adjustment of said laser beam in a vertical plane perpendicular to said ball striking surface so that said beam may be projected over the top of a golf ball onto a putting surface at select distances forwardly of said golf ball; and switch means mounted on said handle and electrically coupled to said laser unit for activating said laser unit.

2. The golf putter as defined in claim 1 including said laser putting unit permanently mounted onto said putter head.

3. The golf putter as defined in claim 1 including said switch means electrically coupled to said laser unit by wiring mounted inside said putter shaft.

4. The golf putter as defined in claim 1 including said laser putting unit integrally formed with said putter head.

5. An improved golf putter with laser sighting including a putter shaft, a handle affixed at a first end thereof and a putter head affixed at the other end thereof and having a substantially planar ball striking surface on one side thereof, said improvement comprising:

a laser unit mounted on the putter head including means for directing a laser beam transversely of the ball striking surface when activated, said laser unit being adjustably mounted on said putter head for adjustment of said laser beam in a vertical plane perpendicular to said ball striking surface so that said beam may be projected over the top of a golf ball onto a putting surface at select distances forwardly of said golf ball; and switch means mounted on said handle and electrically coupled to said laser unit for activating said laser unit.

6. The improvement as defined in claim 5 including said laser putting unit permanently mounted onto said putter head.

7. The improvement as defined in claim 5 including said switch means electrically coupled to said laser unit by wiring mounted inside said putter shaft.

8. The improvement as defined in claim 5 including said laser putting unit integrally formed with said putter head.

* * * * *